United States Patent [19]

Tundermann et al.

[11] 4,231,729

[45] Nov. 4, 1980

[54] POWDER ROLLING APPARATUS

[75] Inventors: John H. Tundermann, Monroe; Charles B. Goodrich, New York, both of N.Y.

[73] Assignee: Huntington Alloys Inc., Huntington, W. Va.

[21] Appl. No.: 83,178

[22] Filed: Oct. 9, 1979

[51] Int. Cl.[2] ..... B22F 3/18; B30B 11/00; B30B 3/00

[52] U.S. Cl. ..... 425/79; 425/363; 425/366; 425/368

[58] Field of Search ..... 425/79, 363, 366, 368

[56] References Cited

U.S. PATENT DOCUMENTS

| | | | |
|---|---|---|---|
| 2,904,829 | 9/1959 | Heck | 425/79 |
| 2,932,852 | 4/1960 | Melville et al. | 425/79 |
| 3,124,838 | 3/1964 | Lund et al. | 425/79 |
| 3,144,681 | 8/1964 | Krantz et al. | 425/79 |
| 3,162,708 | 12/1964 | Lund et al. | 425/79 X |
| 3,203,045 | 8/1965 | Naeser et al. | 425/79 |
| 3,242,530 | 3/1966 | Hirsch et al. | 425/79 |
| 3,298,060 | 1/1967 | Michalak | 425/79 |
| 4,167,377 | 9/1979 | Oakley | 425/79 |

*Primary Examiner*—J. Howard Flint, Jr.
*Attorney, Agent, or Firm*—E. A. Steen

[57] ABSTRACT

Powder rolling apparatus, for the production of strip equal in width to the length of the roll faces, is provided with edge restraint devices in the form of wheels fitted with pneumatic tires and mounted in the roll gap region to be freely rotatable about axes which are perpendicular to, but preferably not coplanar with the roll axes. The wheels are driven by frictional contact between the smooth tread surface of the tires and the end-faces of the rolls.

5 Claims, 3 Drawing Figures

POWDER ROLLING APPARATUS

FIELD OF THE INVENTION

The present invention relates to the compaction of metallic powder to strip or sheet form by rolling, and is particularly concerned with improved powder rolling apparatus which is provided with edge restraint means for controlling the lateral flow or spread of powder in the roll gap.

BACKGROUND OF THE INVENTION

As is well known, metal powders (which term is used herein to include powders consisting at least in part of one or more metals and/or alloys) can be compacted by feeding them to the intake side of a gap between a pair of rolls. The powder may be compacted at ambient or elevated temperature, and the strip-like product which issues from the exit side of the roll gap may be flat surfaced, though contoured rolls may be used to provide any desired surface profile on the product.

In all powder rolling applications, a problem is posed by the tendency of powder to spread laterally in the roll gap, i.e., at right angles to the rolling direction. Such a tendency results in the production of strip having weak, low density edges, so that an edge trimming operation becomes necessary. In large scale operations, particularly of the continuous type, it is highly desirable to be able to avoid or to at least to minimize any edge trimming needed since such trimming is not only a labor intensive operation but also represents wasted energy associated with the large amount of scrap produced thereby. The problem of controlling strip edges is particularly acute where the apparatus is designed to produce a strip extending over the entire length of the roll gap. In such a case the lateral spread of powder results in egress of the powder from the roll gap. It is with the production of such strip, i.e., the width of which is substantially equal to the length of the roll faces, that the present invention is particularly concerned.

In the past various methods have been suggested for controlling the edge of a strip produced by powder rolling. One type of edge control involves the use of a stationary restraint member urged against the end-faces of the rolls in the vicinity of the roll gap, thereby acting as a closure for the roll nip area. Alternatively, it has been proposed to provide flange-like constructions which are fixed to one of the rolls or integrally constructed therewith so as to overlap the other roll at the extremity thereof or in a groove provided near the extremity thereof. Further alternatives which have been suggested involve the use of one or more rollers mounted with their axes orthogonal to the roll axes and forced against the end-faces of the rolls, or used to urge a strip of metal or rubber into contact with the roll end-faces. Yet another approach which has been advocated involves feeding an edge-restraint strip into the roll gap at both extremities thereof, with the powder being fed between the strips.

None of the above-mentioned approaches has provided an entirely satisfactory solution to the problem. Typical of their shortcomings are:

I. Whenever the edge-restraint device is a stationary member, a static powder zone results in the roll nip region and the strip produced exhibits edges of low density, or even unconsolidated edges;

II. Many of the designs suggested do not adequately prevent powder egress from the roll gap because they make only a tangential contact with the roll end-faces;

III. Devices which employ a moving surface to restrain the strip edge generally cease to operate effectively when wear of that surface takes place. Such wear is inevitable when contact is made with the end-faces of the rolls since different points on these end-faces move, in operation, with different linear velocities;

IV. In the case of apparatus employing narrow bands or belts which are fed between the rolls, the edge control bands may be easily damaged, or they may become entrapped in the metal strip produced. Moreover, the use of such bands or belts generally restricts the flexibility of the apparatus for producing strips of different thicknesses.

A more recent approach to the problem is described in the U.S. Patent, Ser. No. 4,167,377 and assigned to the assignee. That approach involves using cylindrical blocks, mounted in the roll-gap region with their axes parallel to the roll axes, and rotated to cause an end face of each block to move in frictional contact with the end faces of the rolls. Inherent in this approach is the continuous wear of the cylindrical blocks and the possibility of contamination of the product by debris from the blocks.

OBJECT OF THE INVENTION

It is an object of the present invention to provide improved powder rolling apparatus which incorporates simple and reliable edge control devices enabling metallic strip as wide as the roll face length to be produced with acceptable edges which do not require substantial subsequent trimming.

SUMMARY OF THE INVENTION

The present invention provides apparatus for compacting metal powders consisting of a pair of generally cylindrical rolls of equal length mounted for rotation about respective parallel spaced roll axes to define a roll gap therebetween, means for feeding metal powder to an intake side of the roll gap along the entire face the rolls to be compacted to a strip-like product of width substantially equal to the roll face and edge-restraint means at opposite axial extremities of the rolls effective to prevent powder egress from the roll gap in a direction parallel to the roll axes, wherein each edge-restraint means comprises a wheel mounted to lie parallel to a plane containing the rolling direction and to be freely rotatable about an axis perpendicular to the roll axes, a pneumatic tire of width exceeding the roll gap mounted on the rim of the wheel, and means for urging the wheel towards the respective end-face of each roll so as to cause a portion of the surface of the pneumatic tire into frictional contact with a portion of the end face of each roll, whereby in operation the wheel is frictionally driven by the rotating rolls and a deformed portion of the tire surface provides a mating powder seal with the roll end-face at, and in the vicinity of, the roll gap.

The deformed region of the tire surface constitutes what is commonly referred to as a footprint, the shape and extent of which is dictated by the distance of the wheel axis from the roll end-faces and the pneumatic pressure in the tire as well as the resiliency and contour of the latter. Successful operation requires a footprint area adequate to cover the space between the rolls not only at the roll gap but in the so-called compaction and feed zones located on the powder intake side of the roll gap. For this reason it is necessary for the tire used to have a width significantly greater than the roll gap, e.g. 5 to 20 times as great.

Because prolonged contact between the edge restraint device and compacted strip is undersirable if damage to the strip is to be minimized, it is preferable to mount the wheels so that their axes of rotation lie parallel to, but not within, the plane containing the roll axes. Instead to wheel axes are displaced from the roll axes plane in a direction opposite to the rolling direction. In this way a greater part of the tire footprint is located on the powder intake side of the roll gap.

To ensure that a footprint of adequate length can be obtained, the wheel diameter should be as large as can be tolerated by constraints imposed by the housing, and in any case it is preferably at least equal to the radius of each roll. The wheel is preferably of solid construction and the tire which is similar to a bicycle tire with smooth tread can be made of a durable elastomeric material. In practice the tire may be of the tubed or tubless type.

The wheel used for edge restraint is not driven independently, but by frictional contact with the roll end-faces. Thus no elaborate controls are needed to match speeds of rotation for enabling variations of roll speeds. It should be mentioned that the surface velocity of the tire will not generally be identical to the velocity of the roll surfaces, instead it may be slightly lower due to the contact of the tire with roll-end portions spaced from the rim of the rolls. This slight difference in speed has not been found detrimental to the successful operation of the apparatus.

A very important advantage of the edge restraint device used in the apparatus of the invention is its ability to provide a substantially uniform powder restraining pressure over the entire footprint area. This pressure is conveniently controlled by appropriate choice of the pneumatic pressure within the tire. Depending on the pneumatic pressure selected, the smooth tread surface of the tire may be bowed out slightly away from the roll-ends, or may penetrate slightly between the rolls, so that the strip produced would be of slightly greater or slightly smaller width than the roll face length. However, whatever the chosen pneumatic pressure, it will be uniform throughout substantially the whole of the footprint region, in contrast to prior advocated devices where solid belts are urged onto the roll-ends by pressure rollers.

We have found that in apparatus according to the invention there is no appreciable wear of the roll-end faces. All that can be observed is a polishing of the portion of these surfaces contacted by the tread surface of the tire. The tire surface itself does degrade slowly, but this does not necessitate any interruption of operations to rectify the degradation. It is possible, and indeed preferred, to dress the tread surface of the tire while the rolling mill is operating. Thus sanding or grinding equipment may be brought to bear on the tire tread surface whenever dressing of the latter is needed.

The invention will now be specifically described with reference to a preferred embodiment thereof wherein the rolls are mounted with their axes in the same horizontal plane for compacting powder fed vertically under gravity.

DETAILED DESCRIPTION OF THE EMBODIMENT

Figure 1:
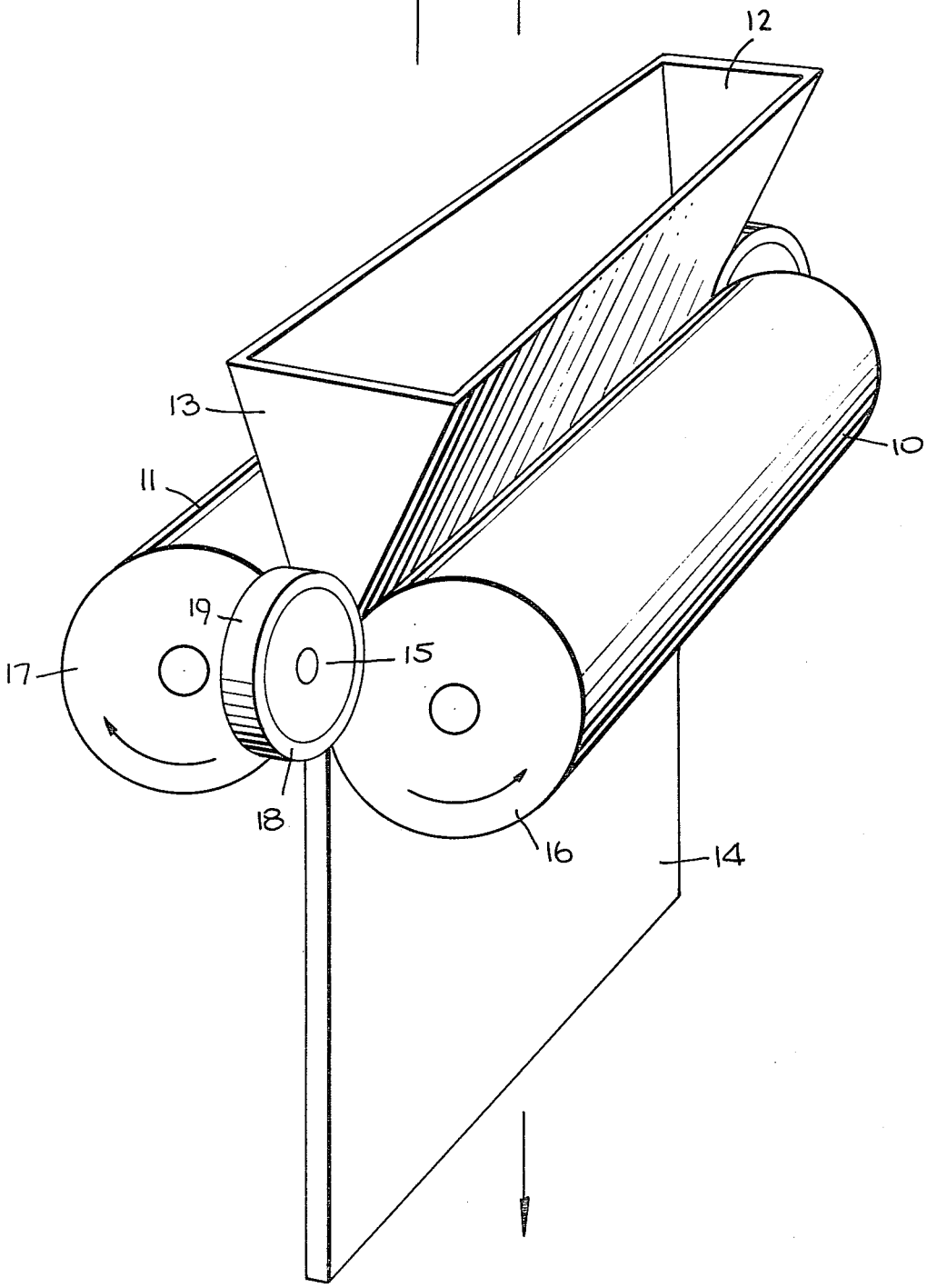
FIG. 1 is a perspective view schematically illustrating an embodiment of the present invention.

In FIG. 1, a pair of rolls 10 and 11 of equal length and diameter are shown in a horizontally spaced configuration. The rolls have generally flat end-faces and are mounted (by means not illustrated) with their end-faces coplanar with one another. A rechargeable hopper 12 is positioned above the rolls. The hopper has sloping side walls which provide a "V" shaped cross section and end walls 13 which fit between the rolls so that powder is discharged from a hopper slot above and close to the roll gap.

Powder fed to the roll gap exits downwards as a compacted strip 14. Edge restraint is provided by a wheel 15 mounted at each axial extremity of the roll gap. Each wheel is mounted by means not illustrated so as to be freely rotatable about its axis, and is fitted with a tire 18 having a smooth tread surface 19 which constitutes the powder-restraining surface. By suitably positioning the wheels, each of the tread surfaces 19 is urged into contact with the end-faces 16 and 17 of the rolls 10 and 11. The footprint area of each tire preferably extends above the lower extremity of the respective end wall 13, thereby preventing powder egress between the tire and the end wall of the hopper.

Figure 2:
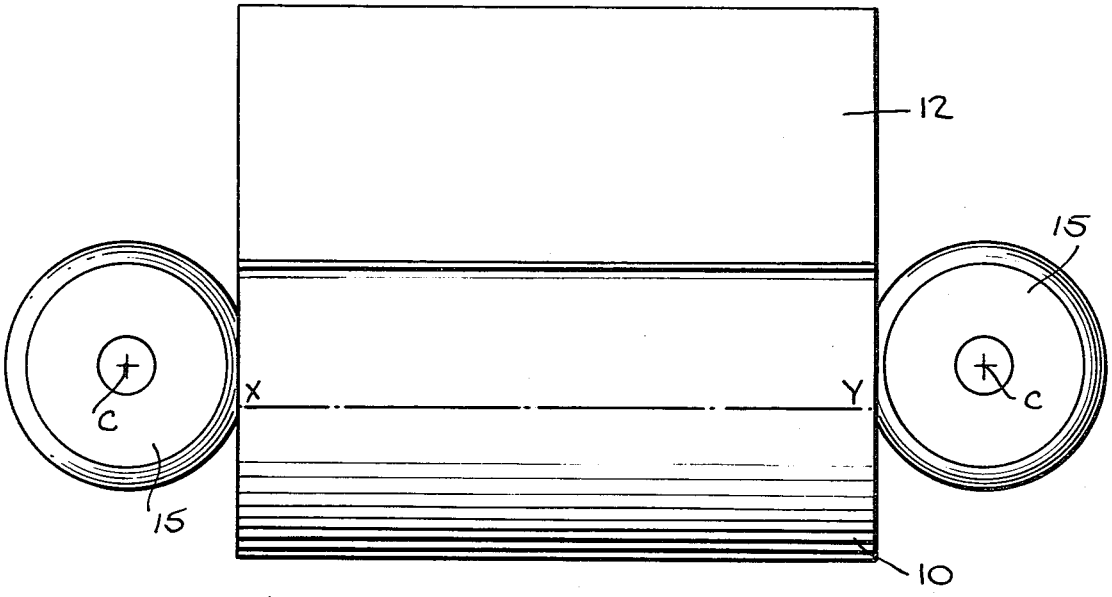
FIGS. 2 and 3 are respectively side elevation and bottom plan views of the apparatus of FIG. 1.

As will be seen from the side view of FIG. 2, the wheels are mounted with their axis C above the line XY which lies in the roll gap. In this way a major portion of the footprint formed by each tire lies above the roll gap to cover the powder feed and compaction zones of the mill. In this embodiment the wheels 15 are mounted on bearings which can selectively be moved through a range of positions so that the center of rotation of each wheel can be moved horizontally towards or away from the roll end-faces, as well as vertically towards or away from the rolling direction. In this way both the area and location of the tire footprint can be controlled.

Figure 3:
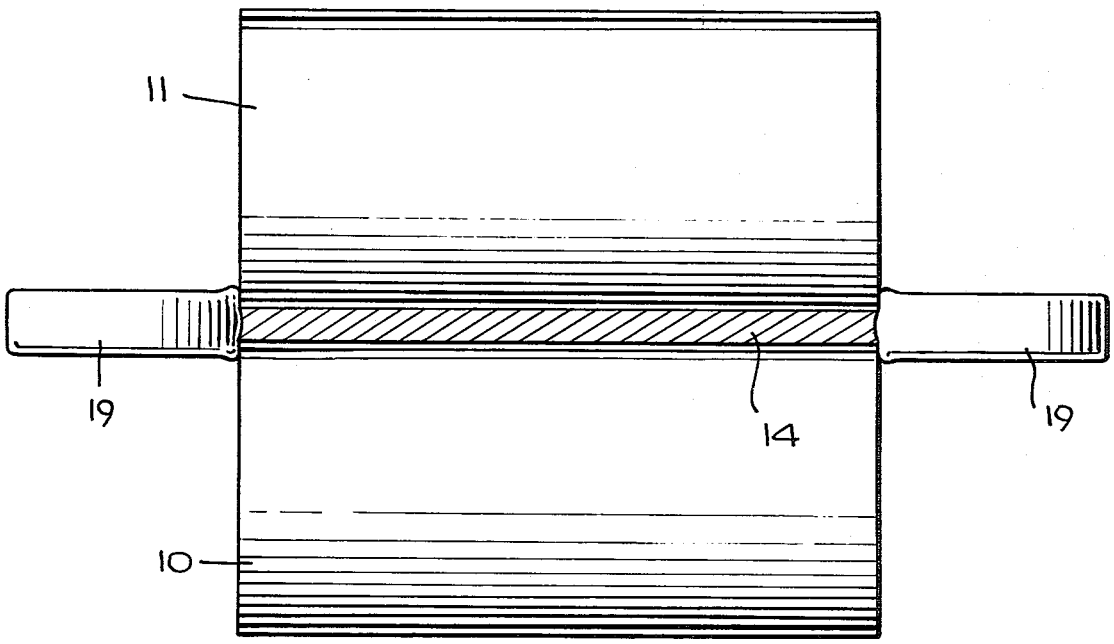

The pressure exerted by the tire on the end-faces of the rolls and on powder therebetween is controlled without significantly varying the footprint area by adjusting the pneumatic pressure within the tires. FIG. 3 illustrates the type of tire distortion (exaggerated for purposes of clarity) which might occur in the vicinity of the roll gap. It shows a footprint slightly wider than the tread surface of the undistorted tire. It also shows some penetration of the tire between the rolls so that strip produced would be slightly less wide than the roll face length. It will be appreciated that neither of these distortions is inherent in the apparatus of the invention. Thus by suitable choice of tire contour, the footprint need not exceed the tire tread width. Moreover by suitable choice of pneumatic pressure the tire need not penetrate the roll gap.

We have tested a rolling mill of the above-described design. The mill included rolls of 90 cm diameter, equipped with edge-restraint wheels of 68 cm diameter. Each wheel was fitted with an elastomeric tire of rectangular cross section providing a side wall height of 2.5 cm and a tread width of 5 cm. The wheels were mounted such as to provide a footprint about 10 cm long, about 8 cm of which lay above the roll gap. The tire which was provided with an inner tube was tested with inflation pressures of 0.34–0.48 megapascals (MPa) and pressures at the low end of this range were found preferable. Using such pressures it was found that strip of acceptable quality was produced with no observable damage to the rolls, the only effect observed being a polishing of part of the wall end-faces.

It is to be understood that the foregoing description of an embodiment of the invention is merely exemplary and many modifications may be made to the details of the embodiment. For example the invention may be embodied in a rolling mill wherein the rolls are vertically superimposed and powder is fed horizontally to the roll gap. Also whereas a powder feed machanism has been described which incorporates a hopper having end-walls which fit between the rolls, alternative hopper designs can be used. For example the hopper may have end-walls which overlap the roll end-faces. The end walls in such a case may have suitable cut-out portions to permit access to the roll end-faces by the edge-restraining wheels. Furthermore, the rolls need not be of identical diameter to one another, nor is it essential that their end-faces be entirely flat providing a portion thereof to be contacted by the restraint member is flat. Such variations and others may be made to the embodiment described without departing from the scope of the invention which is defined by the appended claims.

We claim:

1. In apparatus for compacting metal powders comprising a pair of generally cylindrical rolls of equal length mounted for rotation about respective parallel spaced roll axes to define a roll gap therebetween, means for feeding metal powder to an intake side of the roll gap along the entire length of the roll faces to be compacted to a strip-like product of width substantially equal to the roll face length and edge-restraint means at opposite axial extremities of the rolls effective to prevent powder egress from the roll gap in a direction parallel to the roll axes, the improvement wherein each edge restraint means comprises a wheel mounted to lie parallel to a plane containing the rolling direction and to be freely rotatable about an axis perpendicular to the roll axes, a pneumatic tire of width exceeding the roll gap mounted on the rim of the wheel, and means for urging the wheel towards the respective end-face of each roll so as to cause a portion of the surface of the pneumatic tire into frictional contact with a portion of the end-face of each roll, whereby in operation the wheel is frictionally driven by the rotating rolls and a deformed portion of the tire surface provides a mating powder seal with the roll end-faces at, and in the vicinity of, the roll gap.

2. Apparatus as claimed in claim 1, wherein the axis of rotation of each wheel is displaced from the plane containing the roll axes in a direction opposite to the rolling direction.

3. Apparatus as claimed in claim 2, wherein the diameter of each wheel exceeds the radius of each roll.

4. Apparatus as claimed in claim 1, wherein the width of each tire is at least 5 times the size of the roll gap.

5. Apparatus as claimed in claim 1, wherein the means for urging each wheel comprises a rigid mounting selectively adjustable in the rolling direction and in a direction perpendicular thereto, whereby adjustment of the mounting enables selective variation of the footprint on the tire on the roll end-faces.

* * * * *